United States Patent [19]

Huffnagle et al.

[11] Patent Number: 4,500,157

[45] Date of Patent: Feb. 19, 1985

[54] MOUNTING AND GROUNDING CLAMP FOR SHIELDED CABLE

[75] Inventors: Clifton W. Huffnagle, Camp Hill; LeRoy J. Morningstar, Middletown, both of Pa.

[73] Assignee: AMP Incorporated, Harrisburg, Pa.

[21] Appl. No.: 420,763

[22] Filed: Sep. 21, 1982

[51] Int. Cl.[3] ..... H01R 4/24; H01R 4/66

[52] U.S. Cl. ..... 339/97 R; 339/14 R; 339/17 F

[58] Field of Search ..... 339/14 R, 96, 97 R, 339/17 F

[56] References Cited

U.S. PATENT DOCUMENTS

| | | | |
|---|---|---|---|
| 3,218,602 | 11/1965 | Morse | 339/97 R |
| 3,753,213 | 8/1973 | Frey | 339/97 R |
| 3,820,055 | 6/1974 | Huffnagle et al. | 339/17 F |
| 4,300,017 | 11/1981 | Segretto et al. | 174/36 |

*Primary Examiner*—Eugene F. Desmond

*Attorney, Agent, or Firm*—Adrian J. LaRue

[57] ABSTRACT

A mounting and grounding clamp has opposed members positioned from each other by a bight section. Undulating surfaces of the opposed members are adapted to engage respective surfaces of an insulated wing of a coaxial cable when the clamp is secured thereon via leg members captured by hook members. Contact members of one of the opposed members penetrates the cable wing and electrically engages the shielding material therein.

7 Claims, 8 Drawing Figures

FIG. 1
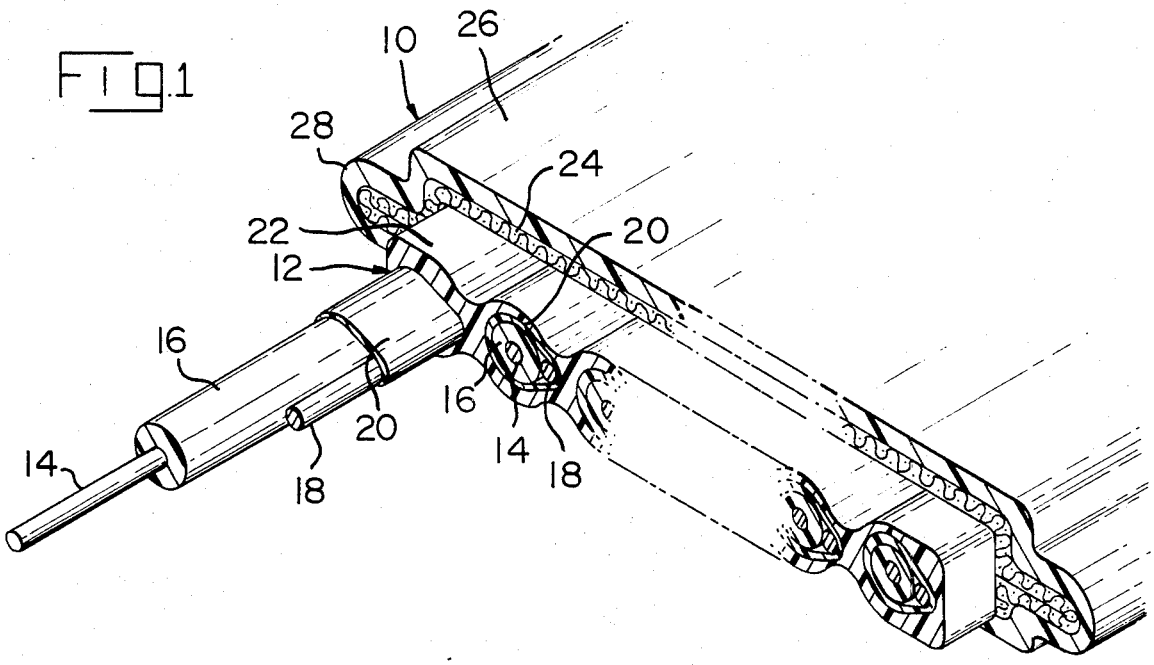
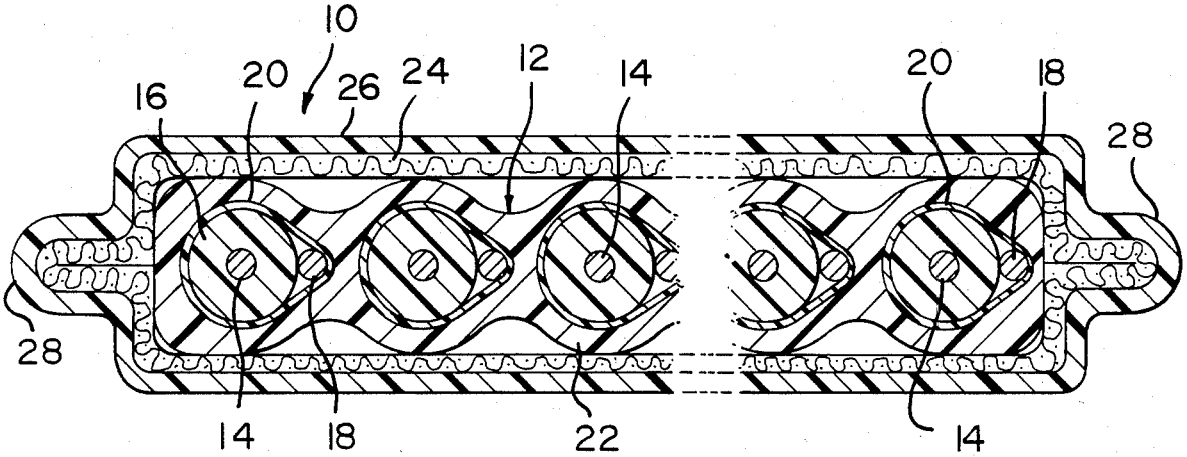
FIG. 2
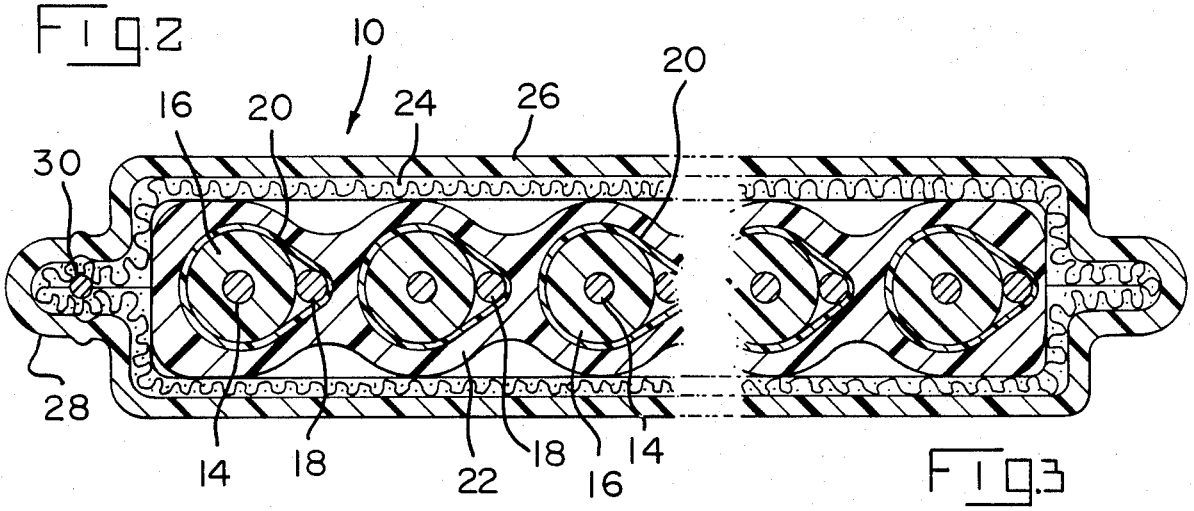
FIG. 3

MOUNTING AND GROUNDING CLAMP FOR SHIELDED CABLE

FIELD OF THE INVENTION

This invention relates to a mounting and grounding clamp and more particularly to a mounting and grounding clamp for shielded cable.

BACKGROUND OF THE INVENTION

Ribbon coax cable of the type disclosed in U.S. Pat. No. 3,775,552 is used to process signal information because it contains a number of signal paths that are shielded from interference problems. This cable is used within electronic equipment to connect electronic circuits but it can also be used externally of the equipment to connect the equipment together.

When the cable is used externally, protection of the cable is essential to protect the cable from wear and abuse and to additionally shield it from crosstalk and interference. Moreover, the cable needs to be effectively grounded at periodic intervals as well as mounted in position. Such a ribbon coax cable comprises a plurality of parallel-spaced and coplanar center conductors, each of the center is conductors covered by a dielectric sheath, a plurality of coplanar, drain wires are selectively disposed among the parallel-spaced center conductors and extending parallel thereto. A conductive layer covers each dielectric sheath and is conductively engaged with a drain wire therealong. Insulation material overlies the conductive layers including the drain wires. Conductive shielding material covers the insulation material and includes projections. An outer dielectric jacket covers the conductive shielding material and the projections thereof defining wings for engagement by a mounting and grounding clamp.

According to another embodiment of such cable, braid ground drain wires extend along the projections of the shielding material and are electrically engagable by the mounting and grounding clamp.

SUMMARY OF THE PRESENT INVENTION

According to the present invention, a mounting and grounding clamp has opposed members positioned from each other by a bight section. Undulating surfaces of the opposed members are adapted to engage respective surfaces of an insulated wing of a coaxial cable when the clamp is secured thereon via leg members captured by hook members. Contact members of one of the opposed members penetrates the cable wing and electrically engages the shielding material therein.

BRIEF DESCRIPTION OF THE DRAWINGS

FIG. 1 is a perspective view with parts broken away of a shielded ribbon coax cable.

FIG. 2 is a cross section of FIG. 1.

FIGS. 3 through 5 are views similar to FIG. 2 showing alternative embodiments of the shielded ribbon coax cable.

DETAILED DESCRIPTION OF PREFERRED EMBODIMENTS

Figure 4:
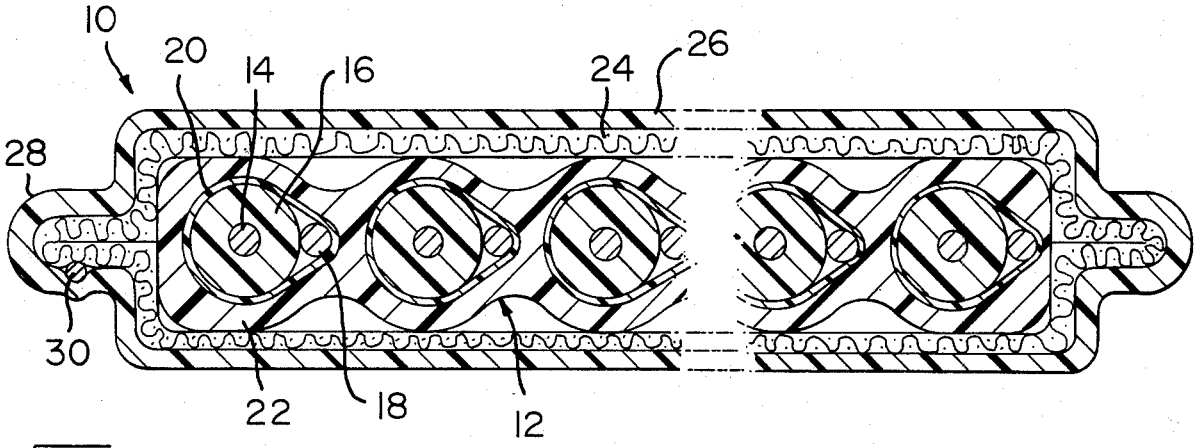
Figure 5:
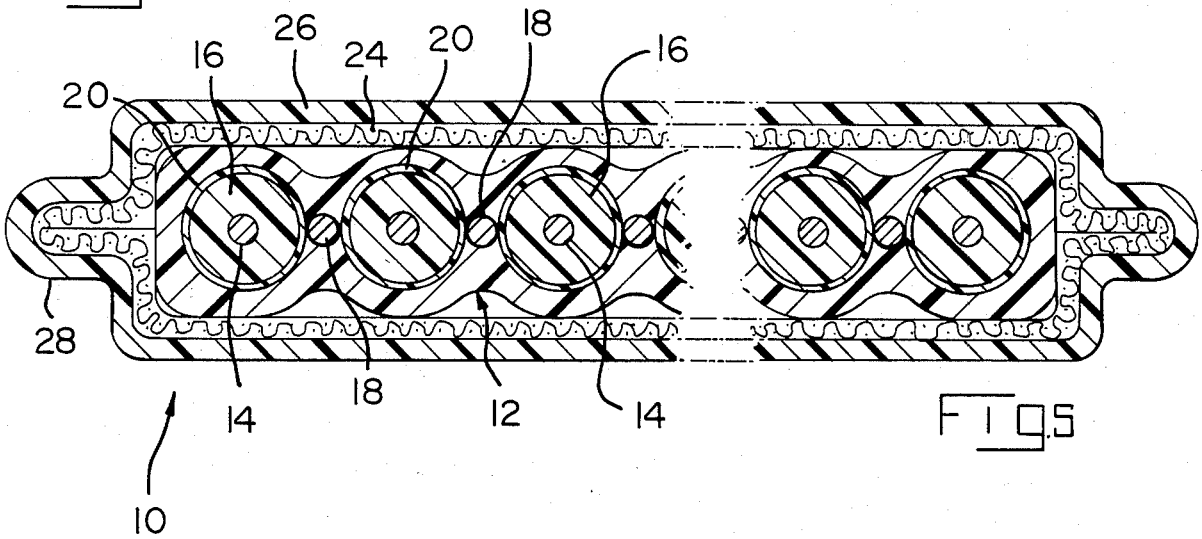

FIGS. 1 and 2 illustrate a shielded ribbon coax cable 10 which includes a ribbon coax cable 12 of the type disclosed in U.S. Pat. No. 3,775,552, the disclosure of which is incorporated herein by reference. Ribbon coax cable 12 comprises a plurality of center conductors 14 around each of which is disposed an insulation sheath 16. Drain or ground conductors 18 extend along respective insulation sheaths 16 and a conductive foil 20 covers a respective insulation sheath 16 as well as electrically engaging drain conductor 18 thereof. Center conductors 14 and drain conductors 18 are preferably of the same or substantially the same diameter. Conductive foil 20 can be a thin metal foil or a metallized plastic. An insulating jacket 22 covers the center conductor and drain conductor assemblies positioning such assemblies with respect to each other thereby forming ribbon coax cable 12 so that center conductors 14 are coplanar and drain conductors 18 are likewise coplanar, and as illustrated, center conductors 14 and drain conductors 18 are coplanar; however, center conductors 14 can be coplanar while drain conductors 18 can also be coplanar but disposed in different planes.

With drain conductors 18 being parallel with respect to center conductors 14, drain conductors 18 are always located at predictable locations which facilitates the stripping of ribbon coax cable 12 to prepare the cable to enable center conductors 14 and drain conductors 18 to be mass terminated in electrical terminals of electrical connectors.

Conductive foil 20 can cover each of insulation sheaths 16 with a respective drain conductor 18 extendininsulation sheaths 16 and parallel disposed drain conductors 18 extend along conductive foil 20 and held in electrical engagement therewith via insulating jacket 22. A drain conductor 18 can be disposed along in electrical engagement with a respective conductive foil 20, or a drain conductor 18 can extend along in electrical engagement with adjacent conductive foils of center conductors 14 so that adjacent center conductor assemblies 14 each including an insulation sheath 16 and a conductive foil 20 can electrically share a drain conductor 18 parallel the disposed relative to center conductor 14 of the adjacent center conductor assemblies.

To more effectively shield ribbon coax cable 12 and to protect it when the cable is used to interconnect electronic equipment, conductive braid 24 and outer dielectric jacket 26 cover ribbon coax cable 12 and it includes projections 28 defining wings extending outwardly from the sides of the ribbon coax cable. Conductive braid 24 is located in projections 28 so that projections 28 can serve to enable a mounting and grounding clamp of the type shown in FIGS. 6 through 8 to be secured thereon for mounting shielded ribbon coax cable 10 in position as well as to provide a ground connection therefor. A conductive foil can also be used in place to braid 24 or as an additional shield.

A braid ground drain conductor or wire 30 can be disposed within the overlapped sections of conductive braid 24 within projections 28 thus serving as a braid ground drain for cable 10 as shown in FIG. 3. If desired, braid ground drain wire 30 can be located between dielectric jacket 26 and the overlapping sections of conductive braid 24 within projections 28 as shown in FIG. 4.

Figure 6:
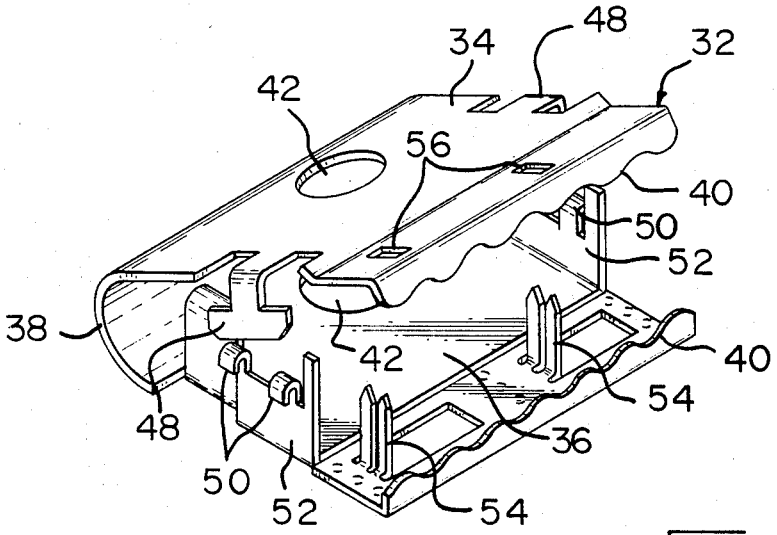
FIG. 6 is a perspective view of a mounting and grounding clamp.
Figure 7:
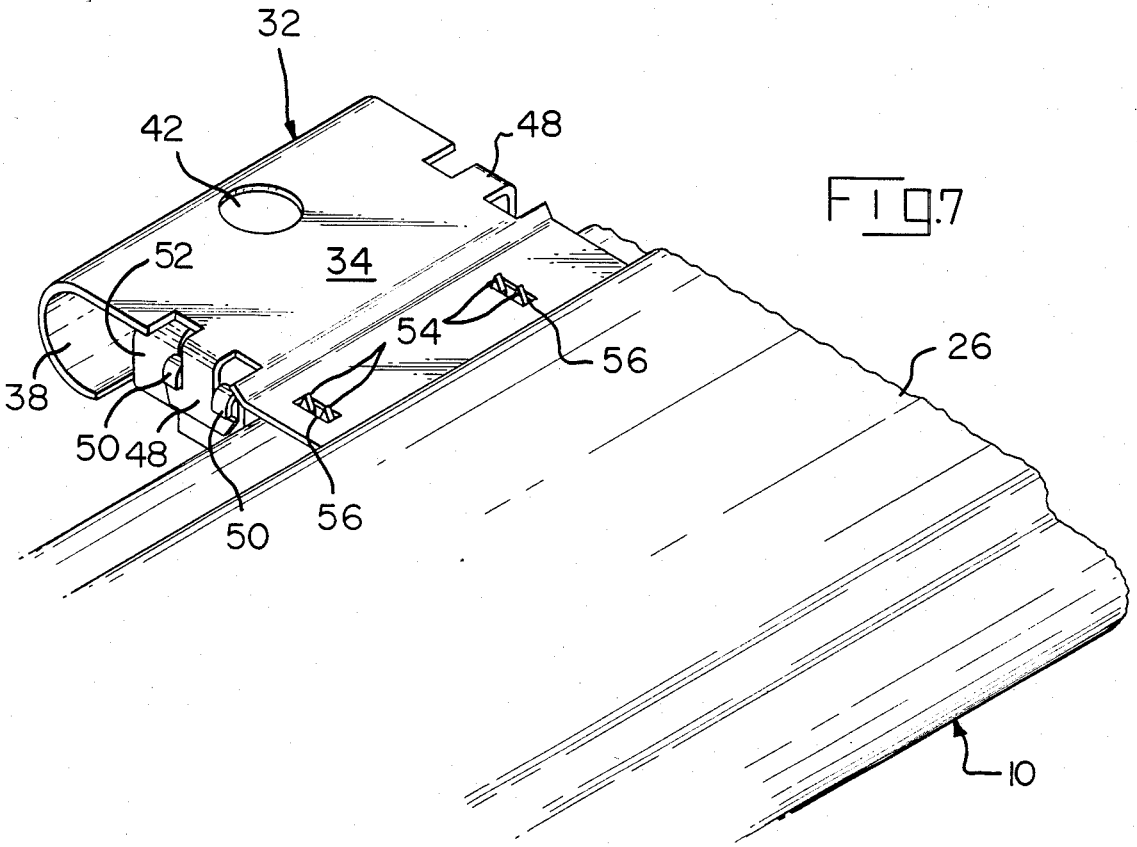
FIG. 7 is a perspective view showing the mounting and grounding clamp in engagement with a wing of a shielded cable.
Figure 8:
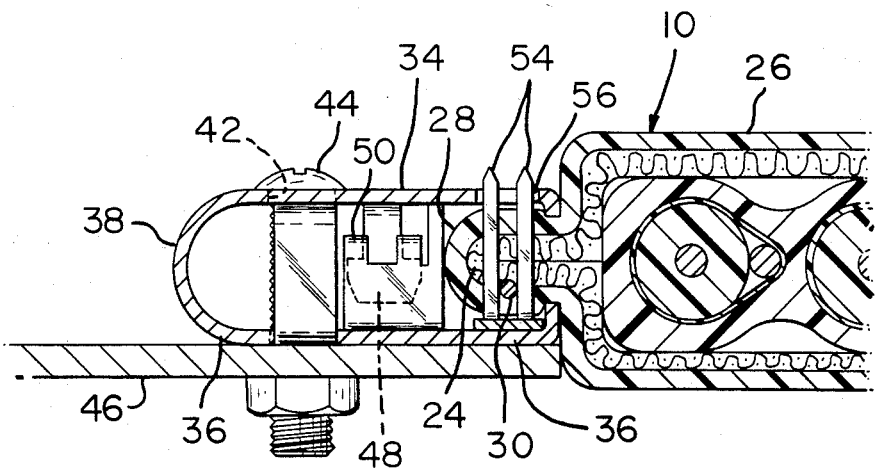
FIG. 8 is a cross-sectional view through part of the shielded cable and the clamp showing the shield contact.

FIGS. 6 through 8 illustrate a mounting and grounding clamp 32 that can be secured onto projections 28 of shielded ribbon coax cable 10 for mounting the cable and for ground connection with the conductive braid thereof. Clamp 32 is stamped and formed from a suitable metal in accordance with conventional stamping and forming practices and it includes opposed leg members 34, 36 connected together by bight section 38. Bight section 38 maintains leg members 34, 36 springably spaced from one another. The outer ends of leg members 34, 36 are bent inwardly and have undulating surfaces 40 therealong. Holes 42 are located in leg members 34, 36 through which a screw 44 extends to secure clamp 32 in position on a metal cabinet 46 or in connection with a metal member to form a ground connection therewith.

Leg member 34 has T-shaped latching members 48 extending outwardly from each side thereof which are to be latchably engaged by spaced hook members 50 located on side sections 52 extending outwardly from leg member 36. Dual contact members 54 extend outwardly from leg member 36 toward leg member 34 between undulating surface 40 and side sections 52 with the outer ends of contact members 54 being pointed and they communicate with rectangular openings 56 in leg member 34 adjacent undulating surface 40.

To secure a clamp 32 onto projection 28 of shielded cable 10, a tool having flat jaws (not shown) moves leg members 34, 36 toward each other causing undulating surfaces 40 to tightly engage projection 28 of cable 10 with latching members 48 moving along arcuate shaped hook members 50 and contact members 54 penetrating through jacket 26 and conductive braid 24 and extending into rectangular openings 56 causing them to be cammed together. Latching members 48, after clearing the ends of hook members 50, spring back into alignment therewith and become latchably hooked therewith upon removal of the tool from clamp 32. Screw 44 is then positioned in holes 42 and secured into position with metal cabinet 46 or the like to mount cable 10 in position and electrically ground braid 24 thereof.

In the event that cable 10 has braid ground drain wires 30 in projections 28 thereof as shown in FIGS. 3 and 4, braid ground drain wire 30 is disposed between dual contact members 54 and when the pointed ends of contact members 54 move into rectangular openings 56, contact members 54 are tightly secured thereto thereby forming an excellent ground connection as well as an excellent clamping arrangement. Contact members 54 score drain wire 30 breaking down oxide coatings thereon thereby forming an excellent mechanical and electrical connection therewith. The mechanical connection is enhanced by the clamping engagement rendered by the dual contact members on the drain wire with their camming engagement within rectangular openings 56 and also by the clamping engagement of undulating surfaces 40 onto outer dielectric jacket 26 of projection 28.

We claim:

1. A mounting and grounding clamp adapted to be secured onto a dielectric jacket and form a ground connection with a conductive shield of a shielded cable, comprising:

opposed leg members having inwardly-directed ends defining undulating surfaces, said undulating surfaces clampingly engaging a section of the dielectric jacket therebetween;

contact means extending outwardly from one of said leg members toward the other of said leg members in alignment with openings in the other of said leg members, said contact means adapted to penetrate through the dielectric jacket into electrical engagement with the conductive shield and extend into said openings;

latch means on said leg members for latching said leg members together with said undulating surfaces in clamping engagement with the section of the dielectric jacket and said contact means in ground connection with the conductive shield and within said openings; and means provided by said leg members for mounting said clamp onto an electrical grounding member.

2. A mounting and grounding clamp as set forth in claim 1 wherein said leg members are springably connected together by a bight section.

3. A mounting and grounding clamp as set forth in claim 1 wherein said contact means include spaced contact members.

4. A mounting and grounding clamp as set forth in claim 1 wherein said latch means include hook members and T-shaped latching members.

5. A mounting and electrical grounding clamp for securing onto an outer insulating jacket of a shielded electrical cable, for electrical connection with a conductive shield of the shielded electrical cable and for mounting onto an electrical grounding member, comprising:

opposed leg means having inwardly-directed edges in the form of undulating surfaces, said undulating surfaces clampingly engaging a section of the outer insulating jacket of the shielded electrical cable therebetween;

means connecting said leg means together;

contact means extending outwardly from one of said leg means toward the other of said leg means in alignment with opening means in the other of said leg means for penetrating through the insulating jacket in electrical engagement with the conductive shield and extending through said opening means when the inwardly-directed edges are clampingly engaged onto the section of the insulating jacket;

means on said leg means for latching said leg means together to maintain said inwardly-directed edges in clamping engagement with the section of the insulating jacket section and said contact means within said opening means; and means for mounting said clamp onto an electrical grounding member.

6. A mounting and electrical grounding clamp as set forth in claim 5, wherein said connecting means is a bight section springably connecting said leg means together.

7. A mounting and electrical grounding clamp as set forth in claim 5, wherein said mounting means comprise aligned holes in said leg means through which a fastening member extends and is secured to the grounding member.

* * * * *